US006352109B1

(12) United States Patent
Buckman, Sr.

(10) Patent No.: US 6,352,109 B1
(45) Date of Patent: Mar. 5, 2002

(54) METHOD AND APPARATUS FOR GAS LIFT SYSTEM FOR OIL AND GAS WELLS

(76) Inventor: William G. Buckman, Sr., 504 Memphis Junction Rd., Bowling Green, KY (US) 42101

( * ) Notice: Subject to any disclaimer, the term of this patent is extended or adjusted under 35 U.S.C. 154(b) by 0 days.

(21) Appl. No.: 09/518,716

(22) Filed: Mar. 3, 2000

Related U.S. Application Data

(60) Provisional application No. 60/124,515, filed on Mar. 16, 1999.

(51) Int. Cl.[7] ..... E21B 43/00; E21B 43/12

(52) U.S. Cl. ..... 166/250.03; 166/53; 166/66; 166/68.5; 166/107; 166/250.15; 166/313; 166/372; 166/374; 417/54; 417/138

(58) Field of Search ..... 166/53, 66, 68, 166/68.5, 69, 107, 177.1, 177.2, 177.6, 250.03, 250.15, 313, 319, 325, 372, 374; 73/152.58; 417/54, 138, 139

(56) References Cited

U.S. PATENT DOCUMENTS 3,894,814 A * 7/1975 Morgan ..... 417/138 X
3,941,510 A * 3/1976 Morgan ..... 166/68 X
3,991,825 A * 11/1976 Morgan ..... 166/68
4,408,676 A * 10/1983 McCoy ..... 181/113
4,842,487 A * 6/1989 Buckman et al. ..... 417/138 X
4,934,186 A * 6/1990 McCoy ..... 73/152.58
5,006,046 A * 4/1991 Buckman et al. ..... 166/372 X
5,337,828 A * 8/1994 Jennings, Jr. ..... 166/372
5,597,042 A * 1/1997 Tubel et al. ..... 166/250.15 X
5,735,346 A * 4/1998 Brewer ..... 166/250.03
6,179,056 B1 * 1/2001 Smith ..... 166/313

* cited by examiner

*Primary Examiner*—George Suchfield
(74) *Attorney, Agent, or Firm*—Baker Botts L.L.P.; Claude E. Cooke, Jr.

(57) ABSTRACT

An intermittent gas lift well pumping system containing an accumulator, a gas line, a liquid discharge line, and a battery operated controller. By using one or more constrictions in the gas line and acoustical techniques, accurate liquid level is determined in the pumping system for optimum production. Bypasses are connected between the gas line and the liquid discharge line. Each contains a valve that opens at a preset absolute pressure in the gas line, an orifice, and a one-way valve. The bypasses are strategically placed to prevent overloading of the system. A liquid slug sensor on the upper end of the liquid discharge line and a rabbit in this line enables optimum production and gas conservation.

15 Claims, 2 Drawing Sheets

METHOD AND APPARATUS FOR GAS LIFT SYSTEM FOR OIL AND GAS WELLS

CROSS-REFERENCE TO RELATED APPLICATION

This application claims the benefit of U.S. Provisional Application No. 60/124,515, filed Mar. 16, 1999.

BACKGROUND OF THE INVENTION

1. Field of the Invention

This invention pertains to pumping liquids from a well in the earth. More particularly, method and apparatus are provided for controlled gas lift system to pump liquid from a well.

2. Description of Related Art

Gas lift systems are used in the initial production of many oil and gas wells and are excellent systems to employ when the gas supply and reservoir pressure are adequate to produce the liquid in a gas conserving manner. After reduction of the reservoir gas pressure and thus the reservoir supply, one usually has to make a decision concerning the method of pumping when the reservoir pressure is not sufficient for economical regular gas lift to continue. Intermittent gas lift systems are often employed rather than beam pumps because of their flexibility, low initial capital cost per well pump, low operational costs, and economical use of gas in the lift. For example, the energy costs for the inventor's system pumping a shallow well at a depth of 1400 feet required only one kilowatt-hour of electrical energy to lift a barrel of oil to the surface and at today's costs, the cost of energy to run a compressor with this system was less than $0.10 per barrel of oil lifted. Obviously, if gas is available for running the compressor, the electrical costs can be reduced or eliminated. Professor Juvkam-Wold of Texas A&M University analyzed the inventor's data obtained for gas lifting a shallow 860 feet depth well and obtained an amazingly low gas/fluid ratio of only 327 standard cubic feet of gas per barrel of oil produced.

Beam pumps have the major advantage that one usually needs only to turn on the electricity and the system pumps until the liquid is pumped-off from the bore hole. Few beam pumps operate on wells where the liquid level in the bore hole is monitored, and the pumps usually just operate a certain length of time to pump-off the liquid.

Numerous gas lift systems exist and primary inventors and United States patents are: Ridley, U.S. Pat. No. 5,860,795; Jennings, U.S. Pat. No. 5,337,828; Buckman, U.S. Pat. Nos. 4,842,487 and 5,006,046 and Morgan, U.S. Pat. No. 3,941,510. An excellent source concerning the design of gas lift systems and valves is the "CAMCO GAS LIFT MANUAL" written by Herald W. Winkler and Sidney Smith, CAMCO, INCORPORATED, 7010 Ardmore, Houston, Tex. 77021. Daniel Oil Tools Company located at 153 South Long Drive, Lafayette, LA 70505 is also producer of gas lift valves along with many other oil field tools.

A difficulty with most intermittent gas lift systems is that because of their complexity, it takes more knowledge and skill to design and operate the system. A very major problem for gas lift systems is that they get overloaded with the liquid in the well, that is, too much liquid accumulates into the well and when the system goes to pump the hydrostatic head is too great for the applied pressure. This occurs if there is a rush of liquid into the well for any reason. Also, if the system has been off for any amount of time because of shut-in due to production constraints, because of lack of electrical power due to weather, or for any other numerous reasons, the well often becomes overloaded with liquid and excessive pressure is required to unload the well. A common method used in the field to unload a well is to swab it, which is a tedious and very messy process.

Monitoring the liquid level in a well and pumping at appropriate times reduces the probability of overloading the gas lift pumping system and enables improved production from the well. Buckman uses in U.S. Pat. Nos. 4,842,487 and 5,006,046 an electrical thermistor in the shallow wells with his pumping systems. A problem with this method is maintaining the sensor downhole. Sonic methods have been used for decades to determine the liquid level in wells. U.S. Pat. Nos. 5,121,340; 4,700,569; 4,934,186 and 4,408,676 are representative patents illustrating the methods and technology in measuring liquid levels using acoustic and ultrasonic techniques. In U.S. Pat. No. 4,934,186, McCoy uses a pop gun assembly to initiate a pressure pulse and a microphone at the top of the well to detect the reflected pulses from tubing collars and from the top of the liquid in the well.

What is needed is a gas lift system that automatically and accurately measures the liquid level in the well and maintains the proper level to enhance the production of liquid/gas from that well. The system should also have the ability to unload the liquid from the well regardless of the amount of accumulation in the well. The system must also be energy efficient as well as conserving of gas during pumping.

SUMMARY OF THE INVENTION

This invention is an intermittent gas lift system for pumping liquids from shallow wells and it has a gas line, an accumulator, a liquid discharge line and a battery operated controller. The lower part of the gas line has a constriction and a pressure transducer is at the top of the gas line. By measuring reflection time intervals of the reflected pulses from the constriction, the bottom end of the gas tube and, subsequently, reflection from the top of the liquid once it rises inside the gas tube, accurate liquid levels in the gas line and the bore hole can be determined to enable the pumping cycle to be initiated for maximum production. Bypasses are connected between the gas line and the liquid discharge line. Each bypass contains a pressure valve that opens at a set absolute pressure from the pressure in the gas line, an orifice, and a one-way valve to enable the pressure activated valve to operate at appropriate gas line pressures. Bypasses are strategically placed at different elevations to eliminate the potential of overloading the system. Overloading the system occurs when the liquid hydrostatic head due to the liquid slug in the second tube becomes greater than the pressure available to be applied in order to pump the slug from the well. A liquid slug sensor at the top of the discharge line and a rabbit traveling in the liquid discharge line enables optimum production and gas conservation.

OBJECTS AND ADVANTAGES OF THE INVENTION

The primary object of the present invention is to provide a low cost and energy and gas efficient method for removing liquids from shallow gas or oil wells. The present invention uses a rather unique apparatus and method to accurately determine the height of the liquid in the bore hole and the appropriate time to initiate pumping to enable optimum production. Elements also exist in the present invention to enable the system to continue to pump with optimum efficiency and to overcome the overload condition which handicaps many gas lift systems. Elements also exist in this system to terminate the pumping cycle at the appropriate time so as to increase production and also to conserve gas due to gas blow-by at the end of the pumping cycle.

DETAILED DESCRIPTION OF THE PREFERRED EMBODIMENTS

Figure 1:
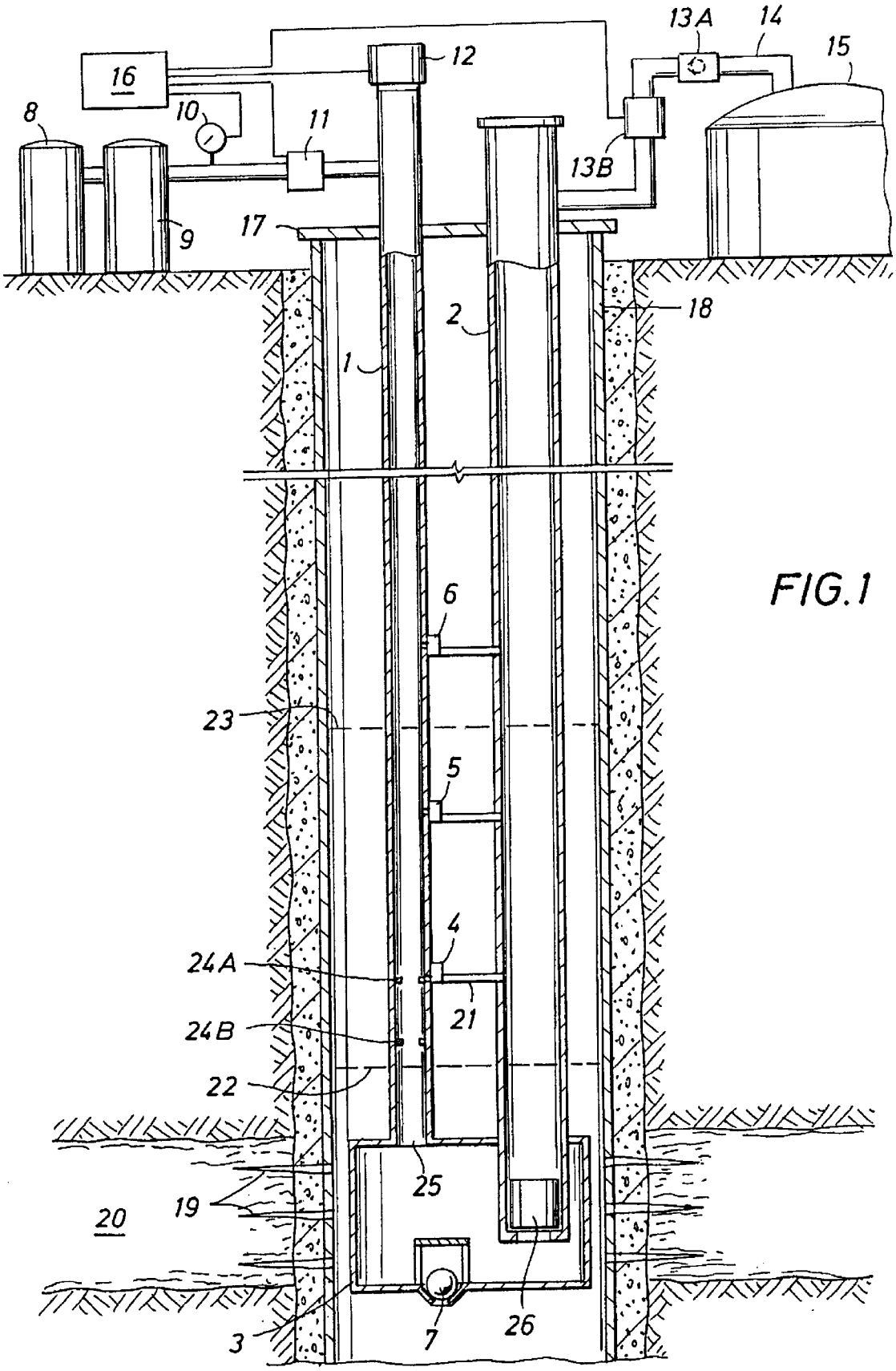
FIG. 1 is a general schematic sectional view of the preferred embodiment of the gas lift system.

A general diagram of the present gas lift pumping system is illustrated in FIG. 1. An accumulator (downhole pump tank) 3 is in the well bore to receive fluid from the bore hole through a one-way check valve 7. A first hollow tube (gas line) 1 extends from the accumulator 3 to a pressure transducer 12 near the surface of the well and through a valve 11 to a gas reservoir tank 9 and to a pressurized gas source 8. A second hollow tube .(liquid discharge line) 2, extends from near the bottom of the accumulator 3 to the top of the well to a slug sensor 13B and through a spring loaded check valve 13A to an oil/water collection tank 15. Located at particular heights above the accumulator 3, a bypass 21 connects the first tube 1 through a pressure valve, an orifice, and a check valve to the second hollow tube 2, which is the oil/water discharge line 2. In this diagram there are three bypasses designated 4, 5, and 6 located at different distances above the accumulator 3. A battery powered well controller 16 monitors the gas reservoir pressure gauge 10, the input and signals from the pressure transducer 12, and the slug sensor 13B. The well controller 16 activates and deactivators the solenoid operated three-way valve 11. The system is to activate and start pumping when the liquid level is at height designated as 22. The pressure pulse waves from the pressure transducer 12 pass down the gas tube 1 and are reflected at the constriction 24A in the first tube at the location of connection of the lowest bypass and also from the bottom of the first tube 25, where it connects to the enclosure. One can also use the reflected pulses from constrictions 24A and 24B, if a constriction at 24B exists. The velocity of the acoustical pulse between the constriction in the first tube 24A and the bottom of the first tube 25 at the enclosure will depend upon the constituents of the gas, the pressure, and the temperature. The battery powered controller measures the difference in the times of traversal of the acoustic pulses from the transducer to the first constriction and back to the transducer and to the end of the first tube and back to the transducer. Knowing the distance the first constriction is from the end of the first tube, the average velocity of the pressure (acoustic) waves at the lower part of the air line is then this known distance divided by the time that it takes the acoustic pulse to go from the end of the tube to the constriction. Then by measuring the time between the reflected pulse from the constriction 24A and the top of the liquid, the distance the height of the liquid is below the constriction in the first tube is determined by multiplying the velocity by the time interval determined for the pulse to go from the top of the liquid to the first constriction. When the liquid reaches the appropriate height 22 in the gas line 1, the controller is signaled to start the pump cycle. If the pressure sensor 10 indicates to the controller 16 that sufficient pressure exists in the gas reservoir tank 9, the well controller 16 opens the three way valve 11 to enable the pressurized gas to go down the first tube (gas line) 1 and to propel the liquid down the first tube 1 and out of the accumulator 3 and up the second tube (liquid discharge line) 2 and to the slug sensor 13B and through the spring loaded check valve 13A and to the liquid holding tank 15. When the slug of liquid encounters the slug sensor 13B, the well controller 16 receives a signal to close the three-way solenoid activated valve 11 in a short predetermined time, such as a few seconds. When the three way valve 11 is deactivated, it closes off the pressurized gas tank from the gas line 1 and it vents the gas line 1 to the atmosphere or other elements of the system, such as the liquid collection tank 15, to reduce the pressure in the first tube down the bore hole pumping system. This reduced pressure in the first tube 1 and the accumulator enables the liquid to flow from the bore hole into the accumulator (pump tank) 3. For deeper wells, where fallback is a major problem as the column is being lifted up the second tube 2, one can use a traveling plunger(often called a rabbit) 26 to push the liquid slug to the top of the well to improve the pumping efficiency of the system.

Consider now that for some reason the system has not been pumping recently and the liquid is very high in the bore hole and in the pumping system. This could be due to shut down in production due to a storm, or for other reasons. Assume the level is at level 23 in FIG. 1. In this case, without any of the bypasses(4,5, or 6) between the gas line 1 and the second tube (liquid discharge line) 2, when pressure is applied to the first tube (gas line) 1, the liquid will rise higher in the liquid discharge line 2 until the hydrostatic head is equal to the applied pressure. This is equivalent to pressure raising liquid in a U-tube. However, as time goes on, the pressure in the gas line 1 continues to increase until the valves in the bypasses are(4,5,and 6) open at each of the bypasses. Then the gas passes first through the valve and bypass 6 into the second tube and to cause the slug of liquid above that level to go up the liquid discharge line 2 and to the oil collection tank 15. At the same time, valves in bypasses 4 and 5 are open. After the liquid is unloaded above the bypass 6 level, then gas passes through bypass 5 and causes the liquid above that level to go up the liquid discharge line 2 to the collection tank 15. Subsequently, the liquid is removed by passing through bypass 4 and the associated valve to unload the liquid above this level. In this system valve 4 at that bypass is usually set to open at a lower pressure than valves 5 and 6; however the system still did not have enough pressure to unload the liquid above valve 4 initially. After pumping the liquid above bypass 4, the pressure in the first tube 1 is sufficient to force the remaining liquid down the first tube 1, out of the accumulator 3 and up the second tube 2 to the collection tank 15. One must be careful that the source of gas and gas pressure is sufficient to maintain the pressure to keep valves 4, 5, and 6 open while unloading the rest of the system. The orifices in the bypasses need to be of sufficient diameter to enable sufficient fluid to flow through the bypass to enable the liquid to be pumped up the second tube 2 and out of the well and the diameter must also be sufficiently small that the gas supply 8 has the capacity to maintain the pressure at a high enough pressure to keep the valve in each bypass open. For shallow wells and readily available gas compressors, usually orifices between diameters of from 1/16 inches to 1/8 inches will suffice. By the above pumping procedure, the pumping system is removed from its overload liquid level and returns to normal pump cycles with the valves 4, 5, and 6 closing and remaining closed during the normal pump cycles.

Figure 2:
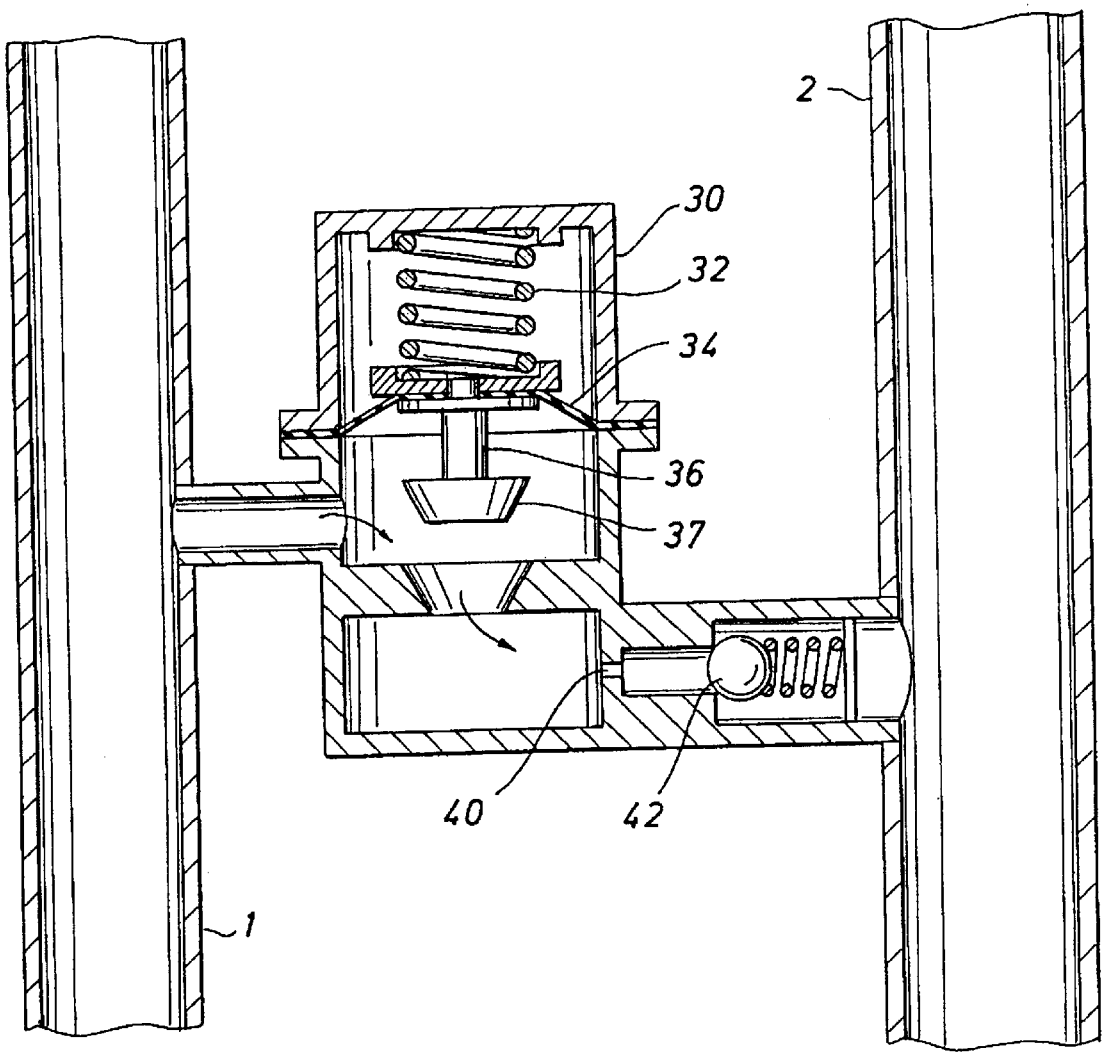
FIG. 2 is a diagram of the arrangement of a bypass tube connection between the first and second tubes. Note that the bypass tube contains a pressure activated valve, an orifice, and a one-way valve.

FIG. 2 contains a diagram illustrating a bypass between the first tube 1 or gas line and the second tube 2 or liquid discharge line. The bypass consists of a pressure activated valve 30, an orifice 40 and a one way valve 42. The pressure activated valve 30 at each bypass is preset to open at a particular absolute pressure in the first tube 1 or gas line. The one way valve 42 is employed so that fluid only passes from the first tube to the second tube and it also keeps the liquid back pressure in the second tube from affecting the opening pressures of the pressure activated valve 30. Systems can be operated using only an orifice in the bypass; however, then fluid is always flowing through each bypass and this is an inefficient use of gas. The pressure activated valve 30 is illustrated in FIG. 2. It consists of a spring 32, a movable diaphragm 34, a valve stem 36 and a valve head 37 that seats when the valve is closed. Assuming $A_d$ is the effective area of the diaphragm, $A_s$ is the effective area of the stem, and $A_h$ is the effective area of the valve head (both bottom or top), and PT is the absolute pressure in the first tube, then the net force up on the diaphragm when the valve is closed is given by:

$$\text{Net force up}=[P_T(A_d-A_s)-P_T(A_v-A_s)]=P_T(A_d-A_v).$$

If $P_T$ is 175 psia, $A_d$=1 in$^2$, and $A_v$=⅞ in$^2$, then the net force is about 22 pounds of force up. Therefore, if the spring tension 32 force is set to close at 21 pounds of force, the valve will open at this pressure. After opening, the first tube applied pressure is also acting on the bottom of the valve head. Then the pressure must decrease considerably to about 22 psia before the valve will close. One should observe that if the one-way valve is not functioning, then the back pressure of the liquid from the liquid discharge tube will keep the pressure activated valve 30 open and it will not open or close at the appropriate first tube pressures. Hence the check valve at each bypass must be installed and operate for the pressure activated valve to operate properly.

EXAMPLE

Consider now the details of a gas lift pumping system raising oil from a depth of 1,000 feet below the surface. One can either use a pressurized reservoir or compressor 8 to provide a gas volume rate of 17 cubic feet per minute at 200 psi. A Quincy 5 horsepower gasoline engine will usually suffice to supply pressure to several wells. The three-way valve 11 can be a Versa VSG-3521-120V60 valve obtained from Versa Products Company in Paramus, N.J. The gas line and oil lines can be regular oil field steel or polyethylene gas line rated at or above 200 psi. For shallow wells, the first tube (gas line) 1 is typically ¾" I.D. and the second tube (liquid discharge line) 2 is normally 1" I.D. The accumulator (pump tank) 3 can be made of plastic or stainless steel and it is usually of cylindrical shape that has a volume that ranges from one gallon to over 20 gallons. Let us use an accumulator (pump tank) 3 that holds twelve gallons. An applied pressure of 200 psig is applied to the first tube (gas line) 1 and from the gas tank 9 and of course the applied pressure in the gas tank 9 initially decreases due to the gas filling the first tube (gas line) 1 and continues to decrease as the liquid slug starts moving up the second tube (liquid discharge line) 2. One atmosphere of pressure (14.7 psi) will raise water 33.7 feet and oil with a density of (0.9 gms/cubic centimeter) to a height of 37.4 feet. Hence, an applied pressure of 200 psig is equivalent to a hydrostatic head of water being 460 feet and a column of oil (of 0.9 density) being 510 feet. The lowest bypass 4 is located 100 feet above the bottom of the first liquid discharge line 2 and this lowest bypass contains an orifice of ⅛" inner diameter. A pressure pulse wave is generated by a pop of high pressure gas or a piezoelectric crystal or the snap of a valve at the top of the gas line 1 and the pulse will travel down the gas line 1 and be partially reflected at the constriction 24A and the bottom of tube 1 at 25. If desired, one can have a second constriction 24B and measure the reflected pulses also from the second constriction. Later the liquid will rise from the accumulator 3 and up into the first tube 1. By knowing the distance between the bottom 25 of the first tube and the constriction in the first tube 1 and by measuring the time intervals for the reflected pressure waves from the constriction and the bottom 25 of the first tube 1, the velocity of the pressure pulses in the bottom of the first tube (gas line) 1 can be determined and the height of the oil in the first tube 1 can be determined. The pump cycle is started when the oil reaches a predetermined height 22, let us say 50 feet above the bottom of the oil line. This fluid total to be pumped consists of the twelve gallons in the accumulator, one gallon in the air line, and two gallons in the oil line for a total of 15 gallons. As the liquid slug rises in the second tube 2, it has a length of about 375 feet because each 100 feet of the 1" plastic pipe has a volume of about 4 gallons. The hydrostatic head of this slug of oil with a length of 375 feet is only about 147 psi; hence, the remaining pressure accelerates the slug and overcomes kinetic frictional forces as the slug rises to the top of the well. Usually between cycles the gas tank 9 is pressurized to about 200 psig. When the valve 11 is opened, the pressure at the pressure gage 10 decreases to about 165 psi to fill the air line and accelerate the liquid slug up the oil discharge line 2 before the compressor 8 is energized to start running. The compressor continues until the pressure return to 200 psi in the gas tank 9, which usually occurs after the pumping cycle. This is the normal pumping cycle.

Consider the case where the well has not been recently pumped and the oil is 300 feet above the bottom of the second tube (oil discharge line) 2. Also assume that the lowest bypass is located 100 feet above the bottom of the liquid discharge line 2. If one attempts to pump the well, the hydrostatic head of the total column of the volume of oil {12 gallons in the accumulator, about 6 gallons in the gas line 1 and about 12 gallons in the oil line 2}=30 gallons and that will produce a column of length of about 750 feet in the oil discharge line 2. To pump this will require a hydrostatic pressure of 263 psi just to maintain a 675 feet column of oil (density assumed to be 0.9). Therefore, when the pressure in the gas line builds up to about 180 psi., valve 4 opens because it has been preset to open at 180 psi.(194.7 psia). The second tube (liquid discharge line) 1 holds about 4 gallons per 100 feet and the air line about 2 gallons per 100 feet. As pressure is applied to the gas line, for each two feet that the liquid goes down in the first tube gas line 1, one expects the liquid to rise about one foot in the second tube (liquid discharge line). With 180 psi applied to the gas line, the difference in heights between the top of the oil in the oil line and the top of the oil in the gas line is 180 psi×37.5 feet/14.7 psi=458 feet. Therefore the liquid in the oil discharge line 2 will move up 458 feet/3=153 feet above its original position after the 180 psi pressure is applied. With the bottom bypass valve 4 open and an orifice of ⅛" I.D. orifice, the gas will cause the slug of oil above this bypass level up the oil discharge line 2 and out of the oil well. The differential pressure initially across the bypass when valve 4 first opens will be about (180 psi—353 ft above bypass×14.7 psi/37.5 feet of oil)=about 42 psi. The attached table illustrates that about 14 cubic feet of free air (@ 14.7 psi) per minute or about 3.5 ft$^3$/min at 60 psi flows through the orifice under these conditions. This is sufficient to propel the oil slug up and out of the well. When the pressure in the gas line 1 is reduced to the pressure that the valve 4 closes, this valve closes and the system is back to pumping normally.

EXAMPLE

Consider the unlikely event where the liquid rises 700 feet above the bottom of the second tube (liquid discharge line) 2 and the liquid will be in the first tube (gas line) 1, and 12 gallons of liquid is in the accumulator (pump tank) 3. Assume the first bypass 4 is 100 feet above the bottom of the liquid discharge line 2, and the spacing between each of the higher bypasses is 300 feet. Upon applying 180 psi to the gas line, the liquid rises in the second tube (oil/water) line such that the height is 180 psi×37.5 feet oil/14.7 psi=459 feet above the level in the first tube 1. Since again for each two feet that the liquid goes down in the first tube (gas line) 1, the liquid rises one foot in the second tube (oil line)(2); therefore, the liquid level in the second tube will now be (153 feet plus 700 feet) 853 feet above the bottom of the second tube (oil/water line) 2. When the applied pressure reaches 180 psig (194.7 psia), valve 4 will open but the system can not pump the liquid column in the second tube because the hydrostatic head is above 200 psi at the level of the lower bypass and the maximum pressure reached would be 200 psi. The pressure in the first tube 1 keeps increasing until at 190 psi (204.7) valves 5and 6 open, since this is the pressure at which they were preset to open. The orifice for each of these two bypasses is only 1/16" inner diameter and that is sufficient for the gas to pass through the upper bypass 6 to unload the liquid up the second tube 2. Then the oil/water is unloaded above the second bypass. After the oil/water is unloaded down to the second bypass, sufficient pressure exists to unload the liquid in the oil line above the lowest bypass 4, and subsequently the lower liquid is pumped down the first tube 1 and out of the accumulator (pump tank) 3 and up the second tube 2 to the oil collection tank 15. The table below gives the expected flow rate of gas through 1/16" and 1/8" inner diameter orifices for different differential pressures across the orifices.

TABLE 1

DISCHARGE OF AIR THROUGH AN ORIFICE (Approximate)
In cubic feet per minute of free air (14.7 psi) @ 70° F.

| Gage Pressure (psi) = | 25 | 50 | 75 | 100 | 125 | 150 | 175 |
|---|---|---|---|---|---|---|---|
| 1/16" I.D. = | 2.25 | 3.66 | 5.05 | 6.5 | 7.9 | 9.3 | 10.7 |
| 1/8" I.D. = | 9.0 | 14.7 | 20 | 26 | 31.6 | 37.3 | 43 |

While unloading the second tube 2, assume that valves 4, 5, and 6 are open and the pressure across each of them is a differential pressure of 100 psi. The total expected volume rate of gas to keep the valves open at the higher pressures (say 190 psi) in the gas line(1), would be as follows:

(6.5 $ft^3$/min×14.7 psi/190 psi)=0.5 $ft^3$/min @ 190 psi through valve 6, also 0.5 $ft^3$/min through valve 5, and (26 $ft^3$/min×14.7 psi/190 psi)=2 $ft^3$/min through valve 4 for a total of at least 3 $ft^3$/min through the valves at 190 psi. A supply system that supplies over 15 $ft^3$/min at 200 psi is more than sufficient. If one has a plentiful gas supply and desires to set the preset opening of all three valves at 180 psi, one must realize that during the unloading phase, the gas is going through valves 5 and 6 unnecessarily many times when it is only necessary to have valve 4 open. One can always use the old siphon technique in which all bypass orifices are open all of the time; however, this is very inefficient and extremely wasteful of the gas and energy.

It is realized that while the preferred embodiment of the invention has been disclosed herein, further modifications to the preferred embodiment will occur to those skilled in the art and such obvious modifications are intended to be within the scope and spirit of the present invention.

It is claimed:

1. Apparatus for pumping liquid from a well, comprising:

an accumulator adapted to be placed in the well, the accumulator including a one-way valve with an inlet port and openings adapted for connecting to tubes;

a first tube having an upper end and a lower end, the lower end being connected to the accumulator and the upper end having an inlet for gas in proximity thereto, the first tube further having a change in diameter disposed near the lower end of the tube for generating a reflected wave from an acoustic pulse;

a source for an acoustic pulse and a pressure transducer, the source and transducer being disposed in proximity to the top end and above the change in diameter in the first tube;

a second tube having an upper end and a lower end, the lower end being connected to the accumulator and the upper end being adapted for connection to an oil collection line; and a bypass tube disposed at a selected distance above the accumulator and having an orifice therein, the bypass tube connecting the first and second tubes.

2. The apparatus of claim 1 wherein the bypass tube further includes a pressure-activated valve therein.

3. The apparatus of claim 1 wherein the bypass tube further includes a one-way valve therein.

4. The apparatus of claim 1 wherein the first and second tubes are made of plastic.

5. The apparatus of claim 1 further comprising a controller for determining the height of a liquid in the first tube from measurements of the reflected wave from the change in diameter in the first tube, a reflected wave from the bottom of the open first tube, and a reflected wave from a surface of liquid in the first tube and for opening a valve to apply gas pressure to the inlet for gas in the first tube in response to the determined height of the liquid.

6. The apparatus of claim 5 further comprising an oil collection line, the oil collection line including a slug detector for detecting a slug of liquid and sending a signal to the controller for closing the valve at the gas inlet of the first tube.

7. The apparatus of claim 1 wherein the diameter of the orifice in the bypass tube is in the range from about 1/16 inch to about 1/8 inch.

8. The apparatus of claim 7 wherein the orifice is constructed of abrasion-resistant material.

9. The apparatus of claim 1 further comprising a plurality of spaced-apart bypass tubes, each bypass tube having an orifice, a pressure-activated valve, and a one-way valve therein, and being disposed at a selected distance above the accumulator.

10. The apparatus of claim 9 wherein the pressure-activated valve in each bypass tube is adjusted to open at a selected absolute pressure, a lower valve adjusted to open at a lower absolute pressure.

11. A method for pumping liquid from a well, comprising:

attaching a first tube having a change in diameter at a selected location along the tube and a second tube to an accumulator and attaching a bypass tube having an orifice therein between the first tube and second tube at a selected distance from the accumulator and placing the accumulator and tubes in the well, the accumulator including a one-way valve with an inlet port;

placing a source for an acoustic pulse and a pressure transducer in the first tube;

connecting the second tube to an oil collection line;

operating the source for an acoustic pulse and the pressure transducer so as to determine a location of a liquid level in the first tube; and applying gas pressure to the first tube so as to force a liquid in the first tube, accumulator, and second tube into the oil collection line in response to the location of the liquid level in the first tube.

12. The method of claim 11 wherein the bypass tube further includes a pressure-activated valve therein.

13. The method of claim 11 wherein the bypass tube further includes a one-way valve therein.

14. The method of claim 11 further comprising the steps of placing a slug detector in the oil collection line so as to detect the liquid from the second tube and sending a signal from the slug detector in response to the liquid to terminate applying gas pressure to the first tube.

15. The method of claim 11 further comprising the step of placing a rabbit in the second tube to improve lifting of the liquid slug.

* * * * *